US006133926A

United States Patent [19]

Kawai et al.

[11] Patent Number: 6,133,926

[45] Date of Patent: Oct. 17, 2000

[54] INK JET HEAD AND METHOD OF PRODUCING THE SAME

[75] Inventors: Jun Kawai, Tokyo; Kazuaki Masuda, Kawasaki; Masami Kasamoto, Ayase; Teruo Arashima, Kawasaki; Yuji Kamiyama, Fujisawa, all of Japan

[73] Assignee: Canon Kabushiki Kaisha, Tokyo, Japan

[21] Appl. No.: 08/630,751

[22] Filed: Apr. 10, 1996

[30] Foreign Application Priority Data

Apr. 13, 1995 [JP] Japan ..... 7-112329

[51] Int. Cl.[7] ..... B41J 2/14; B41J 2/05

[52] U.S. Cl. ..... 347/63; 347/20; 29/890.1

[58] Field of Search ..... 347/54, 63, 65, 347/69, 56, 20, 42; 29/890.1

[56] References Cited

U.S. PATENT DOCUMENTS

| | | | |
|---|---|---|---|
| 5,095,321 | 3/1992 | Saito et al. | 346/140 R |
| 5,208,604 | 5/1993 | Watanabe et al. | 346/1.1 |
| 5,389,957 | 2/1995 | Kimura et al. | 347/20 |
| 5,432,540 | 7/1995 | Hirasishi | 347/69 |
| 5,485,184 | 1/1996 | Nakagomi et al. | 347/63 |

FOREIGN PATENT DOCUMENTS

| | | |
|---|---|---|
| 0488675 | 6/1992 | European Pat. Off. . |
| 0509491 | 10/1992 | European Pat. Off. . |
| 0578329 | 1/1994 | European Pat. Off. . |
| 0636480 | 2/1995 | European Pat. Off. . |
| 6-198875 | 10/1994 | Japan . |

*Primary Examiner*—Joseph Hartary
*Attorney, Agent, or Firm*—Fitzpatrick, Cella, Harper & Scinto

[57] ABSTRACT

An ink jet head has a first member having a plurality of energy generating elements for generating energy necessary for ejecting ink, a second member having a plurality of grooves separated by land portions, the grooves constituting an array of ink channels leading to an array of ink ejecting openings and the land portions constituting ink channel walls separating the ink channels, and a pressing member for pressing the first member and the second member to each other, thereby joining these members so that the ink channels are formed by cooperation between the first member and grooves in said second member. The height of ink channel walls is varied such that it is smaller at both end regions of the array of ink channels than at the central regions of the array of ink channels. Close and tight contact between the first member and the second member is attained in the central region of the ink channel array where the ink channels actually perform ejection of ink, so that ink can be discharged accurately without any crosstalk between adjacent ink channels, thus ensuring high quality printing.

6 Claims, 10 Drawing Sheets

INK JET HEAD AND METHOD OF PRODUCING THE SAME

BACKGROUND OF THE INVENTION

1. Field of the Invention

The present invention relates to an ink jet head and a method of producing the ink jet head. More particularly, the present invention is concerned with an ink jet head of the type which employs electro-thermal transducers as elements for generating discharge energy. Still more particularly, the present invention pertains to an improved construction for keeping a heater board having the electro-thermal transducers formed thereon and a top plate of the ink jet head in close and tight contact with each other at their joint surfaces.

2. Description of the Related Art

Hitherto, an ink jet head has been known in which electro-thermal transducers are used as the elements which generate energy for discharging ink. In this type of ink jet head, a wiring layer is formed on an exothermic resistor layer so that pairs of electrodes electrically connected to the exothermic resistors are formed. In operation, ink in each of a plurality of channels is heated by the heat from the associated exothermic element formed between the exothermic resistor layer and the electrodes, so that a bubble of ink is generated in the channel so as to eject an ink droplet from the ejection opening leading from the channel, thereby performing printing.

One form of the ink heat head of the type described is fabricated by separately preparing a substrate (referred to also as "heater board") on which the plurality of exothermic resistors are formed and a top plate in which a plurality of grooves are formed, and the heater board and the top plate are joined with each other to make close contact with each other so that ink channels (referred to also as "nozzles") corresponding to the exothermic resistors are formed by the grooves in the top plate.

A method of fabricating an ink jet head of the type described, disclosed in U.S. Pat. No. 5,095,321, employs a heater board as a first member having electro-thermal transducers formed thereon and a top plate as a second member. The second member is placed on the first member such that the ink channels are positioned right above the wirings of the electro-thermal transducers, and pressure is applied by a pressing device such as a spring so as to keep the first and second members in close contact with each other.

More specifically, as shown in FIGS. 7 and 8, a top plate 1300 is juxtaposed to a heater board 100 such that the ink channels are aligned with the electro-thermal transducers, and a pressing device such as a device incorporating springs applies pressure load to the top plate 1300 so as to keep these two members in close and proper contact with each other.

This construction is adopted in order to eliminate problems which may be caused when an adhesive is used. Namely, when an adhesive is used so as to adhere the top plate to the heater board, the adhesive may be spread and squeezed from the gap between these two members so as to fill or contaminate the minute ink channels, with a result that the ink is blocked or safe injection of the ink is hampered. In most cases, the top plate 1300 is made of a synthetic resinous material, because such a material provides a high efficiency of production and because the use of such a material eliminates any risk of rupture of the heater board 100.

The described known structure, however, suffers from a disadvantage in that it is extremely difficult to keep the initial high degree of flatness of the ink channels constituting the nozzle array, because once formed, the top plate 1300 tends to warp due to characteristics peculiar to resinous materials.

More specifically, FIG. 6 illustrates a top plate 1300 warping such that it is convex upward at mid portion of the nozzle array above the level of both end regions of the nozzle array. When this top plate 1300 is juxtaposed to the heater board 100 and pressed onto the heater board with an adequate level of pressure, close contact between the top plate 1300 and the heater board 100 cannot be obtained at the middle portion of the nozzle array, allowing crosstalk between the adjacent nozzles, i.e., release of ejection energy from one nozzle to another, failing to provide high accuracy in the ejection of ink, resulting in serious degradation in the quality of the printing.

It might be possible to eliminate this problem by applying pressure of a level exceeding the above-mentioned adequate level so as to forcibly straighten and level the top plate. Application of such a high pressure, however, tends to cause deformation and rupture of the ink channels in the region where the top plate 1300 contacts the heater board, with the result that the cross-sectional shapes of such ink channels are deformed so as to significantly impair the quality of the print.

Thus, warping of the top plate formed from a synthetic resin is one of the factors which reduce the yield of the ink jet head.

SUMMARY OF THE INVENTION

Accordingly, an object of the present invention is to provide an ink jet head in which the first and second members mentioned above are held with the optimum degree of closeness of contact to each other, so as to eliminate any crosstalk between ink channels, thus ensuring high accuracy in the jetting of ink and consequent high quality of printing, thereby overcoming the above-described problems of the known art.

Another object of the present invention is to provide a method of producing an ink jet head which ensures that the first and second member of the ink jet head are held with the optimum closeness of contact with each other despite any warp of one of these members, thereby improving the yield of production of the ink jet head.

To these ends, according to the present invention, the second member having the grooves defining the ink channels is so formed that the height of the land portion constituting a partition wall separating adjacent ink channels is determined to be smaller at both end regions of the array of the ink channels than at the central portion of the array. According to this arrangement, the first and second members are held with a high degree of closeness of contact despite any warp of the second member, so as to prevent occurrence of crosstalk between adjacent ink channels or nozzles, thus ensuring a high quality of printing.

According to one aspect of the present invention, there is provided an ink jet head comprising a first member having energy generating elements for generating energy necessary for ejecting ink, a second member having grooves separated by land portions, the grooves constituting an array of ink channels leading to an array of ink ejecting openings and the land portions constituting ink channel walls separating the ink channels, and a pressing member for pressing the first member and the second member to each other, thereby joining these members so that the ink channels are formed by cooperation between the first member and the grooves in the second member. The height of the ink channel walls is smaller at both end regions of the array of ink channels than at the central regions of the array of ink channels.

According to another aspect of the present invention, there is provided a method of producing an ink jet head, comprising the steps of preparing a first member having energy generating elements for generating energy necessary for ejecting ink, preparing a second member having grooves separated by land portions, the grooves constituting an array of ink channels leading to an array of ink ejecting openings and the land portions constituting ink channel walls separating the ink channels, preparing a pressing member for pressing the first member and the second member to each other, bringing the first member and the second member into contact with each other such that the energy generating elements are aligned with the grooves, pressing the first member and the second member to each other by the pressing member thereby joining these members so that the ink channels are formed by cooperation between the first member and the grooves in the second. The height of the ink channel walls is smaller at both end regions of the array of ink channels than at the central regions of the array of ink channels.

These features serve to eliminate undesirable wide distribution of the pressing load which is applied to achieve close and tight contact between the first member, i.e., a heater board, and the second member, i.e., a top plate, so that moderate level of pressure can be applied to the region where ink ejecting nozzles are provided. It is therefore possible to obtain close and tight contact between the two members, without necessitating application of excessively large contact pressure load which would lead to destruction of the top plate. Consequently, ejection of ink can be performed accurately without experiencing any crosstalk between adjacent ink ejection nozzles, thus ensuring high printing quality.

In addition, the top plate can be formed with a greater margin or tolerance of warping, so that the yield is improved to reduce the cost of production of the ink jet head.

These and other objects, features and advantages of the present invention will become clear from the following description of the preferred embodiments when the same is read in conjunction with the accompanying drawings.

DESCRIPTION OF THE PREFERRED EMBODIMENTS

The present invention will be described in detail with reference to the accompanying drawings.

FIGS. 7 to 11 are illustrations of an ink jet system which incorporates an ink jet head embodying the present invention, showing an ink jet unit IJU, an ink jet head IJH, an ink tank IT, an ink jet cartridge IJC, an ink jet apparatus IJA and a carriage HC, as well as the relationship therebetween.

The ink jet cartridge IJC is a disposable cartridge which is detachably fixed to and carried by the carriage HC which is installed in an ink jet apparatus IJA. The ink jet cartridge IJC is located on and fixed to the carriage HC by cooperation between the locating means of the carriage HC which will be described later and electrical contacts provided on the carriage HC.

The ink jet system shown in FIGS. 7 to 11 incorporate various novel techniques developed and achieved in the course of accomplishment of the present invention. The whole ink jet system will be described by making reference to these techniques.

A description will be given first of the ink jet unit IJU.

The ink jet unit is a bubble jet type unit employing electro-thermal transducers which are activated to generate heat which causes film boiling of ink in accordance with applied electrical signals, thereby performing printing.

Figure 7:
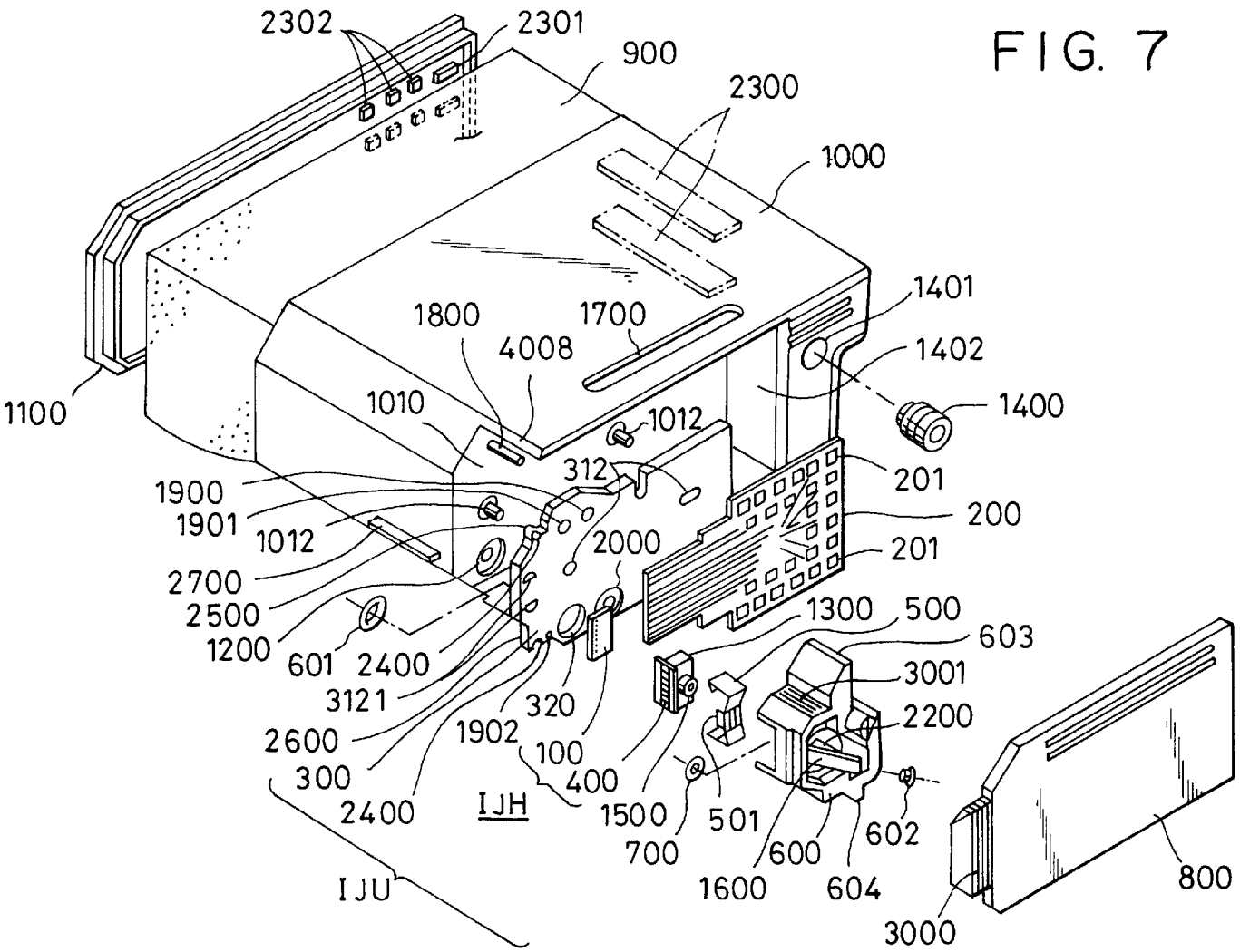
FIG. 7 is an exploded perspective view of an ink jet head in accordance with the present invention.

Referring to FIG. 7, a heater board 100 has an Si substrate carrying a plurality of electro-thermal transducers (ejection heaters) disposed in the form of an array, the transducers being formed by a film-forming technique together with conductor wires made of material such as Al (aluminum) for supplying the transducers with electrical power.

A wiring board 200 has wirings corresponding to the wirings on the heater board 100 and connected thereto by, for example, a wire bonding technique. The wiring board 200 also has pads 201 connected to the ends of the wirings and adapted to be supplied with electrical signals from the main part of an apparatus such as a printer.

A grooved top plate 1300 has grooves which to form ink channels and are separated from land portions serving as ink channel walls. The top plate 1300 also has a recess which serves as a common ink chamber from which ink is supplied to the respective ink channels. The top plate 1300 is fabricated by molding an orifice plate 400 having orifice ports or ejection openings corresponding to the ink channels integrally with an ink filling port 1500 which receive s ink from the ink tank IT and delivers the same to the above-mentioned common ink chamber. Preferably, polysulfone is used as the material from which the top plate 1300 is integrally molded, although the invention does not exclude the use of other types of resin for the molding material.

A metallic support member 300 provides a back-up surface for supporting the wiring board 200, and serves as a bottom plate of the ink jet unit. Numeral 500 denotes a spring serving as a pressing member for pressing the heater board 100 into contact with the top plate 1300. The pressing spring 500 has a substantially M-shaped cross-section taken along a plane parallel to the arraying direction of the ink channels, with a mid portion projected towards the top plate so as to lightly press the portion of the top plate 1300 where the common ink chamber is formed. The pressing spring 500 also has a front tab portion 501 which exerts and concentrates pressure along a line in a region of the ink channel array, preferably a region in the vicinity of the ejection openings.

The arrangement is such that the legs of the pressing spring 500 extend through the apertures 3121 formed in the supporting member 300 into engagement with the back side of the supporting member 300, whereby the heater board 100 and the top plate 1300 are securely joined to each other by the concentrated pressure exerted by the main part of the pressing spring 500 and the front tab 501. The supporting member 300 has locating holes 312, 1900 and 2000 for engagement with a pair of locating projections 1012 on the ink tank IT and locating/welding projections 1800, 1801 provided on the ink tank IT. The supporting member 300 is also provided at its back side with locating projections 2500 and 2600 for locating the carriage HC with respect to the ink jet apparatus IJA.

Furthermore, the supporting member 300 is provided with a hole 320 adapted to be penetrated by a later-mentioned ink supply tube 2200 through which ink is supplied from the ink tank IT. The fixing of the wiring board 200 to the supporting member 300 is made by bonding using an adhesive or the like.

Figure 8:
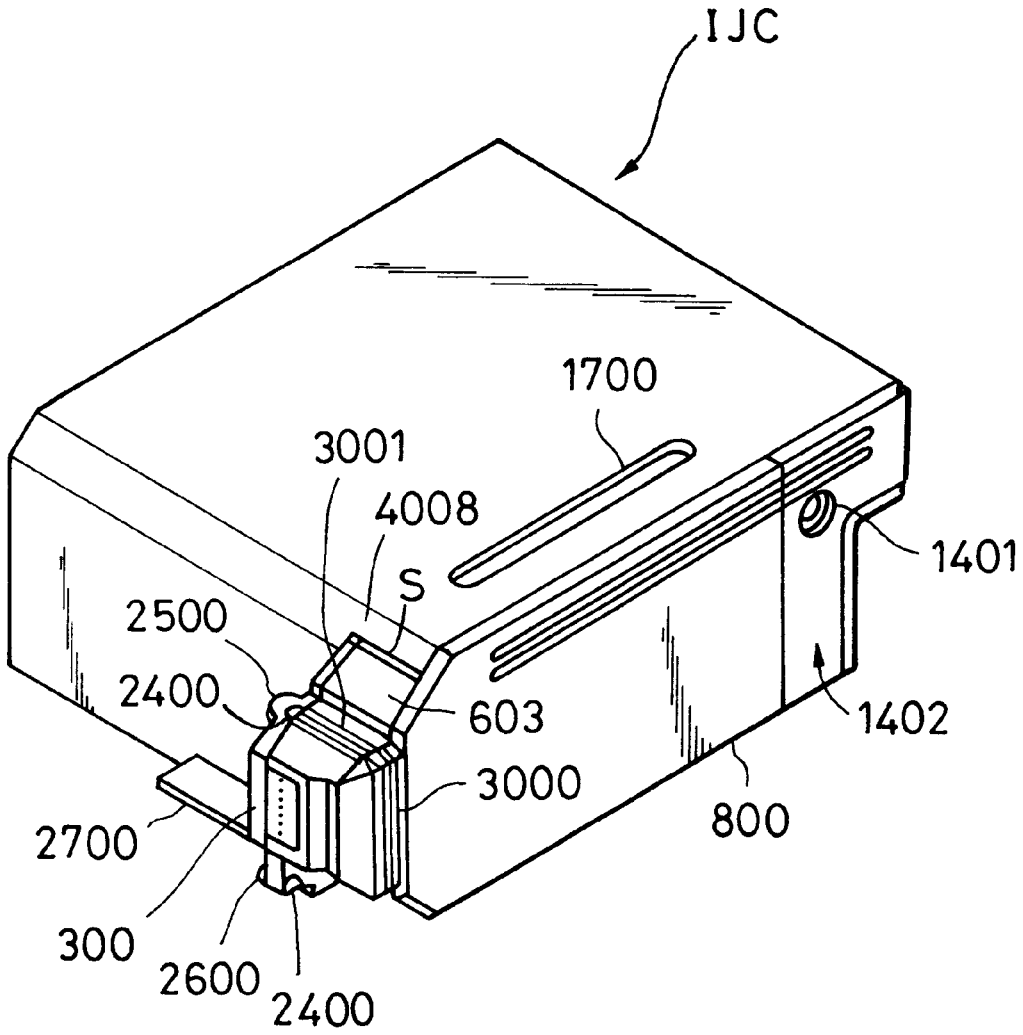
FIG. 8 is a perspective view of the ink jet head in the assembled state.

Recesses 2400, 2400 are formed in the portions of the supporting member 300 adjacent to the locating projections 2500, 2600. In the assembled state of the ink jet cartridge IJC as shown in FIG. 8, these recesses 2400, 2400 are disposed on the extensions of parallel grooves 3000, 3001 formed in three sides of the head end region, and serve to prevent any foreign matter such as dust particles and ink from reaching the locating projections 2500, 2600.

Figure 10:
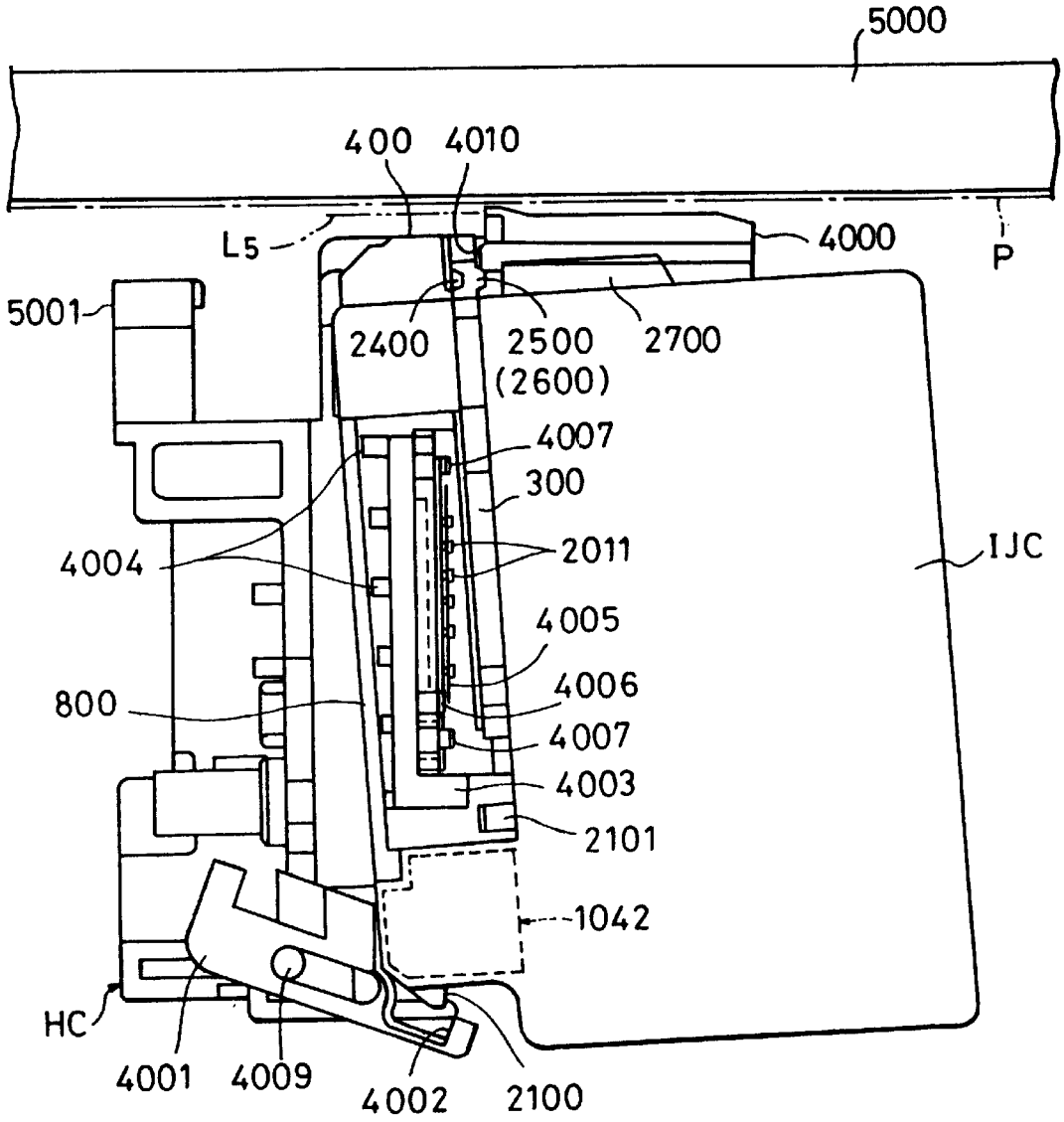
FIGS. 10 and 11 are illustrations of a recording apparatus incorporating the ink jet head of the present invention.

The above-mentioned parallel grooves 3000 are formed in a cover member 800 which, as will be seen from FIG. 10, constitutes an outer wall of the ink jet cartridge IJC and, in cooperation with the ink tank IT, defines a space for accommodating the ink jet unit IJU.

The parallel grooves 3001 are formed in an ink supplying member 600. The ink supplying member 600 has an ink conduit 1600 communicating with the aforementioned ink supplying tube 2200 and which is cantilevered at the end adjacent to the ink supplying tube 2200. A sealing pin 602 is inserted in order to ensure the capillary action in the region between the fixed end of the ink conduit 1600 and the ink supplying tube 2200.

Numeral 601 designates a packing which provides a seal in the junction between the ink tank IT and the ink supplying tube 2200, while 700 designates a filter provided in the end of the ink supplying tube 2200 adjacent to the ink tank IT.

The ink supplying member 600 is formed by molding and, hence, can be produced at low cost with high dimensional precision, thus minimizing errors in production. In addition, the cantilevered structure of the conduit 1600 eliminates any variation in the state of pressure contact between the free end of the conduit 1600 and the aforesaid ink filling port 1500, despite any slight dimensional error which may be caused when ink supplying member 600 is mass-produced.

In this embodiment, a liquid tight communication is achieved simply by supplying a sealant from the ink supplying member, while the free end of the conduit is held in pressure contact with the ink filling port 1500.

The fixing of the ink supplying member 600 to the supporting member 300 can easily be achieved by setting the ink supplying member 600 on the supporting member 300 with the locating pins (not shown) on the back side of the ink supplying member 600 inserted into corresponding locating holes 1901, 1902 formed in the supporting member 300, and fusing and welding the portions of these pins projecting from the back surface of the supporting member 300. The fused ends of the pins project slightly from the back side of the supporting member 300 but such slight projections do not hamper correct positioning of the ink jet unit IJU because such projections are accommodated by recesses (not shown) formed in the ink jet unit mounting surface of the ink tank IT.

A description will now be given of the construction of the ink tank IT.

The ink tank IT has a cartridge main structure 1000 having an ink jet unit mounting surface for mounting the ink jet unit IJU, the main structure 1000 being opened at its side opposite to the ink jet unit mounting surface. The ink tank IT further has an ink absorber 900 which is placed inside the main structure, and a cover member 1100 which closes the above-mentioned opening after the ink absorber is placed in the cartridge main structure 1000.

The ink absorber 900 placed in the cartridge main structure 1000 is adapted to be impregnated with ink. Numeral 1200 denotes an ink supplying port for supplying the ink to the ink jet unit IJU composed of the aforementioned components 100 to 600.

In this embodiment, filling the tank with ink is possible either through the vent hole or the above-mentioned ink supplying port. In order to realize smooth supply of the ink from the ink absorber, ribs 2300 are formed on the inner surface of the main structure 1000 and, at the same time, partial or discontinuous ribs 2301, 2302 are formed on the inner surface of the cover member 1100, so that an air space is formed inside the tank leading from the vent hole 1401 to the ink supplying port 1200 including the region which is most remote from the ink supplying port 1200. The filling of the tank with the ink, i.e., supply of the ink to the absorber, is preferably executed through the ink supplying port 1200, in order to uniformly impregnate the absorber with the ink. This method is practically effective.

There are four ribs 2300 provided on the rear wall of the ink tank portion of the cartridge main structure 1000, so that the absorber is prevented from closely contacting the inner surface of the above-mentioned rear wall.

The partial ribs 2301, 2302 are provided on the portions of the inner surface of the cover member 1100 which are on the extensions of the ribs 2300. Since these partial ribs are segmented, they provide a greater volume of the air space than that provided by the ribs 2300.

The partial ribs 2301, 2302 are distributed over an area which is not greater than half of the entire area of the cover member 1100.

By virtue of the presence of these ribs, the ink can be stably introduced by capillary action to the ink supplying port 1200, even from the corner region which is most remote from the ink supplying port 1200.

The aforesaid vent hole 1401 provides communication between the interior of the ink tank and the ambient air. A liquid repellent member disposed inside the vent hole 1401 serves to prevent ink from spilling out from the vent hole 1400.

The ink tank IT having the described construction defines therein a rectangularly parallelopipedal ink storage space, with the longer sides of the rectangle presenting the side faces of the tank. The above-described arrangement of the ribs therefore can be particularly effective. When the ink storage space has its longer side extending in the direction of movement of the carriage, or when the same is cubic, it is advisable to provide the ribs on the entire area of the cover member 1100, in order to stabilize the supply of the ink from the absorber 900. In order that the quantity of the ink stored in the limited space is maximized, it is preferred that the ink storage space has a rectangular parallelopiped configuration. When such a configuration is adopted, it is important that the ribs which perform the above-described function are provided on the portions of two surfaces adjacent each corner of the space, so that the stored ink can be fully used for printing without waste.

The internal ribs of the ink tank used in the described embodiment are disposed at a substantially constant spacing in the direction of thickness of the ink absorber which also has a rectangular parallelopiped configuration. Such an arrangement of the ribs is important in order that the atmospheric pressure be uniformly distributed over the entire part of the ink absorber so as to ensure that the ink is completely consumed down to the last drop thereof. The technical idea concerning the arrangement of the ribs will be further discussed. An imaginary arc is drawn on the rectangularly top plane of the rectangular parallelopipedal configuration, centered at a point on which the ink supplying port 1200 is projected and with a radius which equals to the length of the longer side of the rectangle. It is important that the ribs are disposed on the portion of the ink tank inner surface which is outside the above-mentioned arc. The position of the vent hole may be changed from the illustrated position, provided that it can introduce air to the region where the ribs are disposed.

In addition, in the illustrated embodiment, the back face of the ink cartridge IJC opposite to the ink jet head IJH is flattened so as to minimize the space occupied by the ink jet cartridge IJC when the latter is mounted in the apparatus, while maximizing the ink storage capacity. This feature contributes to reduction in the size of the whole apparatus and reduces the frequency of renewal of the cartridge. The illustrated embodiment makes effective use of the space behind the ink jet unit IJU secured to the ink tank IT. Namely, a projecting part in which the vent hole 1401 is formed is installed in this space. The internal cavity of this projecting part constitutes an atmospheric pressure supply chamber 1402 which spans the entire thickness of the absorber 900.

By virtue of these features, the ink jet cartridge of this embodiment offers advantages which can never be achieved by known cartridges. The atmospheric pressure supply chamber 1402 in this embodiment is much greater in size than those in the known cartridges of the kind described. Since the atmospheric pressure communication port 1401 is disposed near the upper end of the atmospheric pressure supply chamber 1402, ink which has happened to flow out of the absorber due to any accident can be preserved in the atmospheric pressure supply chamber 1402 and then absorbed again by the absorber, without leaking to the exterior of the cartridge. It is thus possible to obtain a cartridge which can avoid wasting ink.

Figure 9:
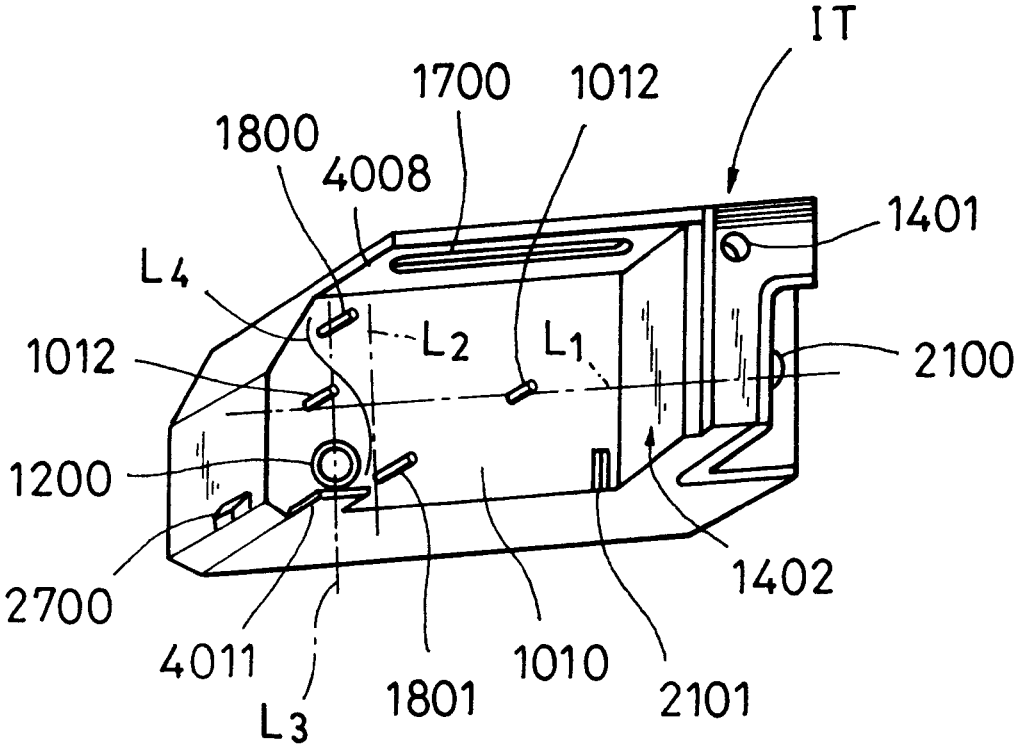
FIG. 9 is a perspective view of the ink jet head.

FIG. 9 shows the surface of the ink tank IT on which the ink jet unit IJU is to be mounted. A straight line L1 is assumed to extend in parallel with the bottom surface of the tank IT or a reference plane on a surface of the carriage, past a point which is substantially amidst the array of the ink ejection openings of the orifice plate 400. The aforementioned locating projections 1012 engaging the holes 312 formed in the supporting member 300 are positioned on this straight line L1. The height of the locating projections 1012 is slightly smaller than the thickness of the supporting member 300. The supporting member 300 is correctly located by the engagement between its holes 312 and the locating projections 1012. A claw 2100 for engagement with an orthogonal engaging surfaces 4002 of a locating hook 4001 on the carriage HC for locating the ink tank IT is provided on the extension of the above-mentioned line L1, so that the locating force for locating the ink tank with respect to the carriage acts on the planar region which contains this line L1 and which is parallel to the above-mentioned reference plane. This arrangement is effective in that the positioning precision of the ink tank IT as a single component is equivalent to the positional precision of the ejection openings of the ink jet head IJH, as will be explained later in connection with FIG. 10.

The projections 1800 and 1801 provided on the ink tank IT, corresponding to the fixing holes 1900 and 2000 formed in the supporting member 300 for fixing the supporting member 300 to a side wall of the ink tank, have a length greater than the length of the aforesaid projection 1012, so that the projections 1800 and 1801 penetrate the supporting member 300 to project therefrom. The portions of these projections projecting from the supporting member 300 is thermally fused and welded, whereby the supporting member 300 is fixed to the side face of the ink tank IT. Two lines perpendicular to the above-mentioned line L1 are assumed: namely, a line L3 which passes the projection 1800 and a line L2 which passes the projection 1801. A point which is substantially on the center of the aforesaid supplying port 1200 is positioned on the line L3. This positional relationship is preferred because it serves to stabilize the state of connection between the port 1200 of the supplying section and the supplying tube 2200, against any load which otherwise may act to disconnect the supplying tube due to application of impact such as by dropping of the cartridge.

The lines L2 and L3 do not overlap, and the projections 1800 and 1801 are arranged around the projection 1012 which is provided at the ejecting side of the ink jet head IJH. These projections 1800 and 1801 therefore produce an effect to assist correct positioning of the ink jet head IJH with respect to the tank.

A curve indicated by L4 represents the position of the outer wall of the ink supplying member 600 in the assembled state. Since the projections 1800 and 1801 are disposed along the curve L4, they provide strength and positional accuracy against the weight of the end portion of the ink jet head IJH. Numeral 2700 denotes a collar provided on an end of the ink tank IT and adapted to be received in an opening formed in a front panel 4000 of the carriage, so as to hold the ink tank IT against any extraordinary condition which may cause a large deviation of the ink tank. Numeral 2101 designates a stopper for preventing the ink jet cartridge IJC from coming off the carriage HC through engagement with a bar (not shown) provided on the carriage HC. More specifically, when the ink jet cartridge IJC has been swung in a manner which will be described later, the stopper 2101 is positioned below the bar on the carriage HC so that, when an unintentional upward force is applied to the ink jet cartridge IJC in the swung state, the stopper 2101 engages with the bar so as to serve as a protection member by preventing the ink jet cartridge IJC from coming off the carriage HC, whereby the ink cartridge IJC is held on the carriage HC without being moved therefrom.

The cover 800 is attached to the ink tank IT after the mounting of the ink jet unit IJU, so that the ink jet unit IJU is encased except for the lower side which remains open. However, when the ink jet cartridge IJC is placed on the carriage HC, the lower open end is positioned in close proximity to the carriage HC, so that the ink jet unit IJU is materially encased in a closed space. The heat generated from the ink jet head IJH is effectively dissipated to the air in this closed space but such heat causes a slight rise of the air temperature in this space during long continuous use of the ink jet system. In order to promote natural heat dissipation, therefore, a slit 1700 of a width smaller than the width of this closed space is formed in the top wall of the ink jet cartridge IJC, whereby a uniform temperature distribution is achieved over the entire portion of the unit IJU without being affected by environment, while preventing excessive rise of temperature.

In the ink jet cartridge IJC as assembled, the ink is supplied from the interior of the cartridge into the ink supplying tank 600, through the supply port 1200, opening 320 formed in the supporting member 300 and an inlet opening formed in the central rear surface of the supplying tank 600. The ink thus introduced into the supplying tank 600 is further introduced into the common liquid chamber through the outlet opening formed in the ink supplying tank, a suitable supplying tube, and an ink inlet opening 150 formed in the top plate 1300. Packings of suitable materials such as silicone rubber, butyl rubber and the like are arranged in the junctions between the above-mentioned portions constituting the path of supply of the ink, so as to provide liquid tight seals, whereby a sealed ink supplying passage is formed.

In the illustrated embodiment, the top plate 1300 is formed by molding in a mold integrally with the orifice plate 400, from a resinous material resistant to ink, such as polysulfone, polyethersulfone, polyphenylene oxide, polypropylene and so forth.

Thus, each of the ink supplying member 600, top plate/orifice plate assembly and the ink tank main structure 1000 is molded as a single part, so that the assembly precision is improved, as well as the product quality when the ink jet system is mass-produced. Furthermore, the number of the parts is reduced as compared with the conventional systems, so that the desired characteristics can be developed without difficulty.

In the illustrated embodiment as assembled, as will be seen from FIGS. 7 to 9, a slit S is formed between the top wall 603 of the ink supplying member 600 and the edge 4008 of the top panel of the ink tank IT having the slit 1700, and a similar slit (not shown) is formed between the bottom wall 604 of the ink supplying member 600 and the head-side edge 4011 of a thin plate member to which the lower cover 800 of the ink tank IT is bonded. These slits formed between the ink tank IT and the ink supplying member 600 serve to promote heat dissipation through the aforesaid slit 1700 and serves also as a buffer which prevents any external force applied to the ink tank IT from being directly transmitted to the ink supplying member 600 and, hence, to the ink jet unit IJU.

The above-described features of the illustrated embodiment are novel and, independently or in combination, provide advantages over known arts.

A description will now be given of the manner in which the ink jet cartridge IJC is mounted on the carriage HC.

Referring to FIG. 10, a platen roller 5000 is adapted to guide a recording medium P towards the viewer who views the Figure.

The carriage HC moves along the platen roller 5000. The carriage HC has a front plate 4000 2 mm thick, provided on the front face of the carriage HC so as to be positioned on the front side of the ink is jet cartridge IJC, an electrical connection supporting plate 4003 carrying a flexible plate 4005 and a rubber pad sheet 4007, and the aforesaid locating hook 4001 for fixing the ink jet cartridge IJC to the recording position. The flexible sheet 4005 has pads 2011 20 corresponding to the pads 201 on the wiring board 200 of the ink jet cartridge IJC, and the rubber pad sheet 4007 serves to press the flexible sheet 4005 and, hence, the pads 2011, from the back side of the flexible sheet 4005.

The front plate 400 has a pair of locating projected surfaces 4010 for engagement with the aforesaid locating projections 2500, 2600 of the supporting member 300 of the cartridge, so that, after the cartridge has been mounted, the front plate 400 bears the force acting on the locating projecting surfaces 4010 perpendicularly thereto. In order to bear such a force, a plurality of reinforcement ribs (not shown) are provided on the side of the front plate adjacent the platen roller, so as to extend in the direction of the above-mentioned force. These ribs serve to form a head protecting projection which projects by a small amount, e.g., about 0.1 mm, from the position L5 of the front face of the cartridge IJC in the mounted state. The electrical connection supporting plate 4003 has reinforcement ribs 4004 extending in vertical direction so as to project laterally and arrayed in the direction towards and away from the platen roller 5000. The height of lateral projection of the reinforcement ribs 4004 is progressively changed in the direction of the array such that the rib 4004 closest to the platen roller 5000 has the greatest height and the rib 4004 closest to the hook 4001 has the smallest height. Such progressive reduction of the projection height serves to enable the cartridge to be mounted with an inclination as illustrated.

In order to stabilize the state of electrical contact, the supporting plate 4003 has a pair of locating surfaces 4006 disposed adjacent to the hook 4001 so as to correspond to the above-mentioned projecting surfaces 4010. These locating surfaces 4006 apply a force to the cartridge in the direction counter to the force exerted on the cartridge by the above-mentioned projecting surfaces 4010. The projecting surfaces 4010 and the locating surfaces 4006 cooperate with each other in defining therebetween a pad contact region. The rubber pad sheet 4007 mentioned before has rubber projections corresponding to the pads 2011. These locating surfaces serve to directly determine the amounts of deformation of the rubber projections. These locating surfaces make contact with the surface of the wiring board 300 when the ink jet cartridge IJC is fixed at the printing position.

In the illustrated embodiment, the pads 201 on the wiring board 300 are arranged in symmetry with respect to the aforementioned line L1, so that the amounts of the rubber projections on the rubber pad sheet 4007 are equalized so as to stabilize the pressure of contact between the pads 2011 on the rubber pad sheet 4007 and the pads 201 on the wiring board. In this embodiment, the pads 201 are arranged in two columns and in two lines at each of upper and lower regions.

The hook 4001 has an elongated hole for engagement with a fixed shaft 4009. This engagement allows the hook 4001 to rotate counterclockwise from the illustrated position, by virtue of a relative movement of the fixed shaft 4009 with respect to the hook 4001 along the elongated hole. The hook 4001 rotated counterclockwise is then moved to the left along the platen roller 5000, thereby locating the ink jet cartridge IJC with respect to the carriage HC. Any suitable means can be used for causing the above-described motion of the hook 4001, although a mechanism using a lever action is preferred.

During the rotation of the hook 4001, the ink jet cartridge IJC, while moving towards the platen roller, brings the locating projections 2500, 2600 to positions where they contact with the locating surfaces 4010. A further leftward movement of the hook 4001 brings the orthogonal hook surface 4002 into close contact with the orthogonal surface of the claw 2100 on the ink jet cartridge IJC and, while this close contact is maintained, the ink jet cartridge IJC is swung in the horizontal plane about the region of contact between the locating surfaces 2500 and 4010, whereby mutual contact between the pads 201 and the pads 2011 is commenced.

When the hook 4001 is fixed to a predetermined fixing position, the ink jet cartridge IJC is correctly located and held on the carriage, while achieving complete contact between the pads 201 and 2011, complete areal contact between the locating surfaces 2500 and 4010, close contact between the orthogonal surface 4002 on the hook 4001 and the orthogonal surface of the claw 2100, and areal contact between the wiring board 300 and the locating surface 4006.

A description will now be given of an ink jet printing apparatus, as an example of the apparatus embodying the present invention.

Figure 11:
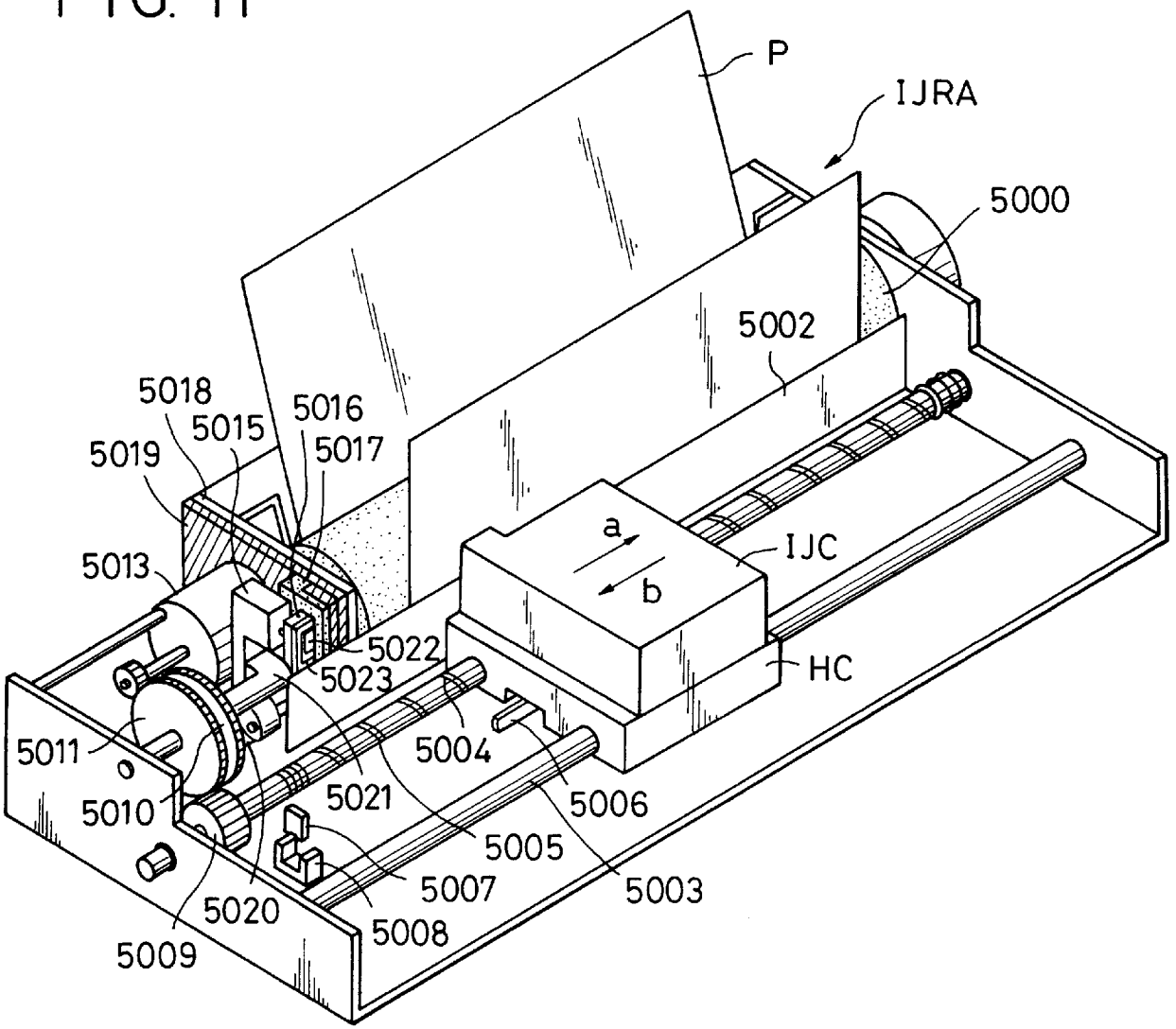

FIG. 11 is a schematic perspective view of an internal structure of an ink jet printing apparatus embodying the present invention. A lead screw 5005 having a spiral groove 5004 is driven to rotate in one or the other direction by forward or backward operation of a drive motor 5013, through operations of power transmission gears 5011, 5009. The carriage HC has a pin (not shown) slidably received in the spiral groove 5004, so that the carriage HC is moved in the direction of the arrow a or b, in accordance with the operation of the drive motor 5013.

Numeral 5002 designates a sheet pressing plate which serves to press a paper sheet against the platen roller 5000 over the entire length of the paper sheet in the direction of movement of the carriage. A photocoupler is composed of two components 5007 and 5008. The photocoupler 5007, 5008 serves as a home position detecting means which, upon detection of a lever 5006 on the carriage, conducts switching of the direction of operation of the motor 5013. Numeral 5016 designates a member for supporting a cap member 5022 which caps the front face of the ink jet head IJH. A vacuum suction means 5015 induces air from the space concealed by the cap through an opening 5023, so as to apply vacuum to the ink ejecting openings of the ink jet head IJH, thereby performing sucking recovery operation for maintaining good condition of ink ejection from the head. Numeral 5017 designates a cleaning blade which is moved back and forth by a member 5019. These members 5017 and 5019 are supported by a main structure supporting plate 5018. Obviously, the illustrated configuration of the cleaning blade is illustrative and any type of known cleaning blades can be used in this embodiment in place of the illustrated cleaning blade 5017.

Numeral 5012 designates a lever for triggering the sucking recovery operation. This lever is moved in accordance with movement of a cam 5020 which engages with the carriage, and is controlled by power transmitted from the drive motor through the known power transmitting means including a clutch or the like.

The arrangement is such that the capping operation, cleaning operation and sucking recovery operation are executed by the action of the lead screw 5005 when the carriage has been brought to positions which are suitable for the respective operations and which are in a region near the home position. This, however, is only illustrative and any suitable mechanism or arrangement may be used to perform these operations at suitable timings.

The features described hereinabove are novel and provide, independently or in combination, remarkable effects over known arts and, hence, are used advantageously in the illustrated embodiment.

A description will now be given of a critical feature of the invention of this application.

Figure 1:
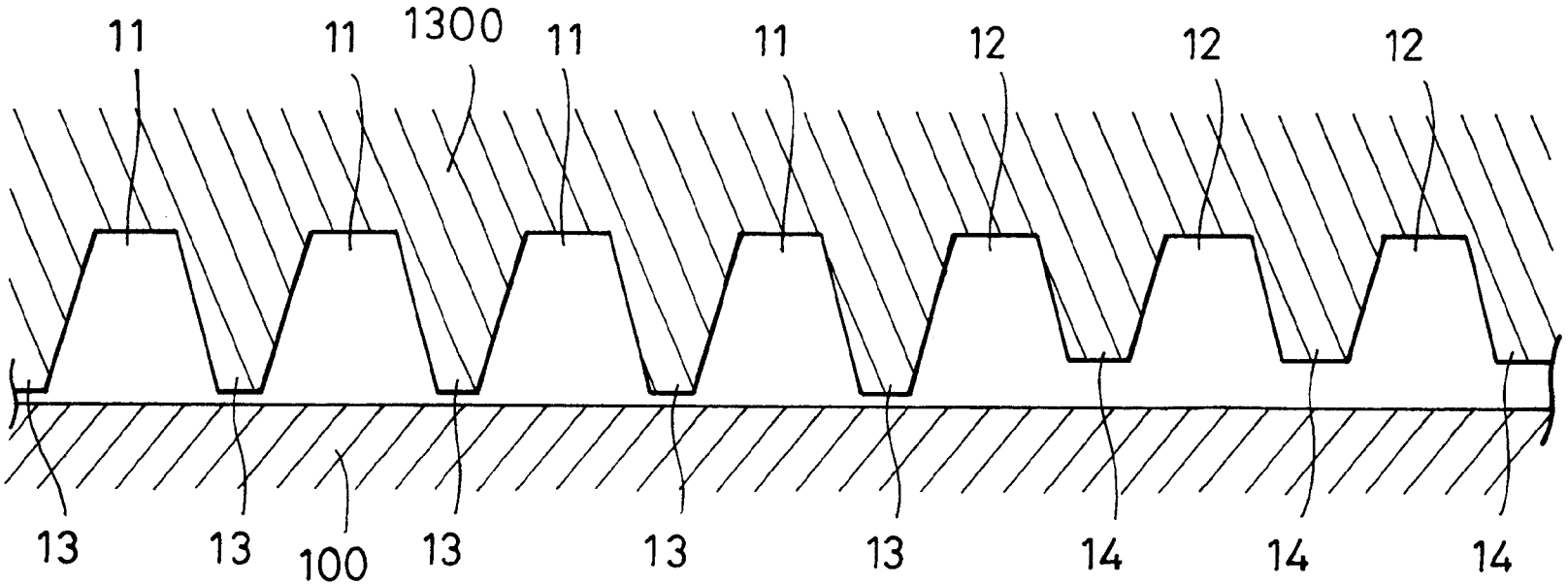
FIG. 1 is a sectional view of a nozzle forming member in accordance with a first embodiment of the present invention, showing the configuration of the joint surface at which the nozzle forming member is joined to a heater board.

FIG. 1 is an enlarged sectional view of a portion of the ink jet head in accordance with the present invention, showing particularly the joining surfaces of a top plate 1300 molded from a resinous material and a heater board 100 having an array of electro-thermal transducers 10 which generate thermal energy. The top plate 1300 has grooves of a trapezoidal cross-section, so that, when the top plate 1300 and the heater board 100 are joined to each other, nozzles are formed by the grooves.

Figure 2:
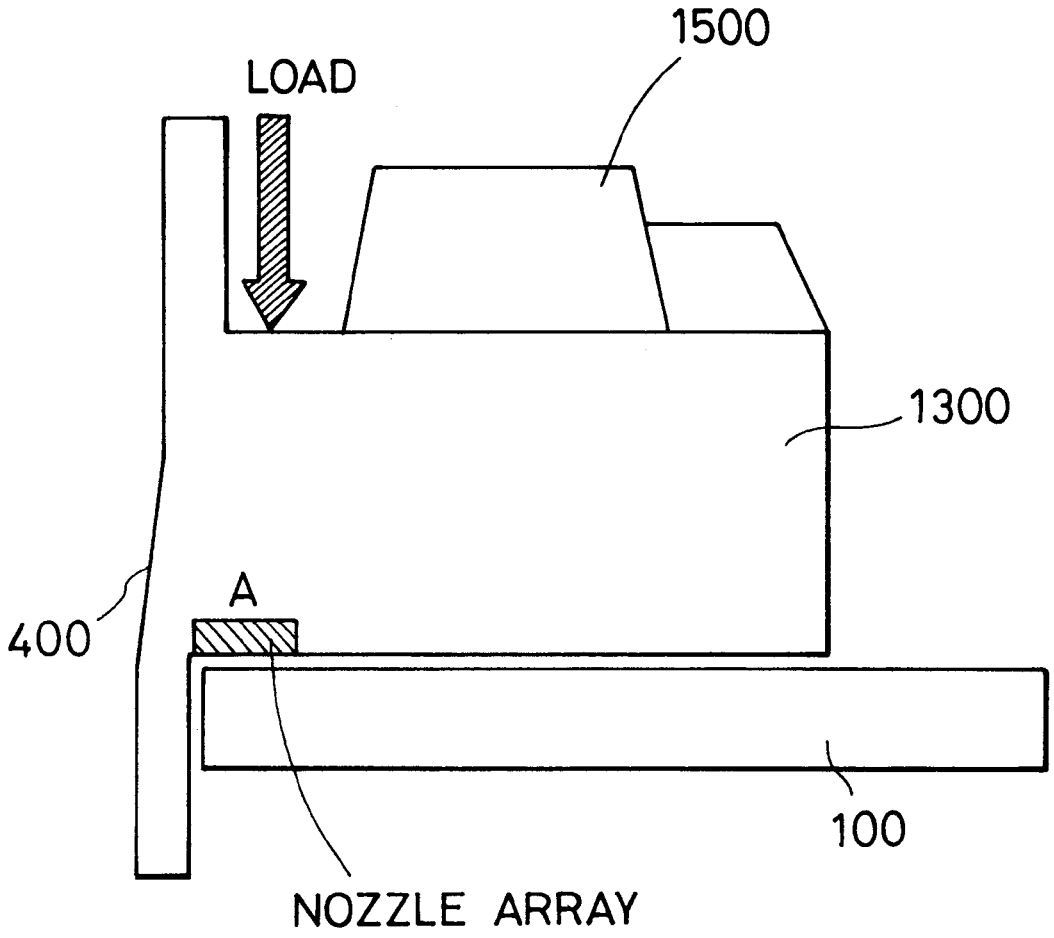
FIG. 2 is a side elevational view of a portion of an ink jet head of the present invention, illustrating the state in which the top plate is joined to the heater plate.

FIG. 2 is a diagrammatic side elevational view of the ink jet head in the assembled state, with the top plate 1300 and the heater board 100 joined to each other.

Figure 3A:
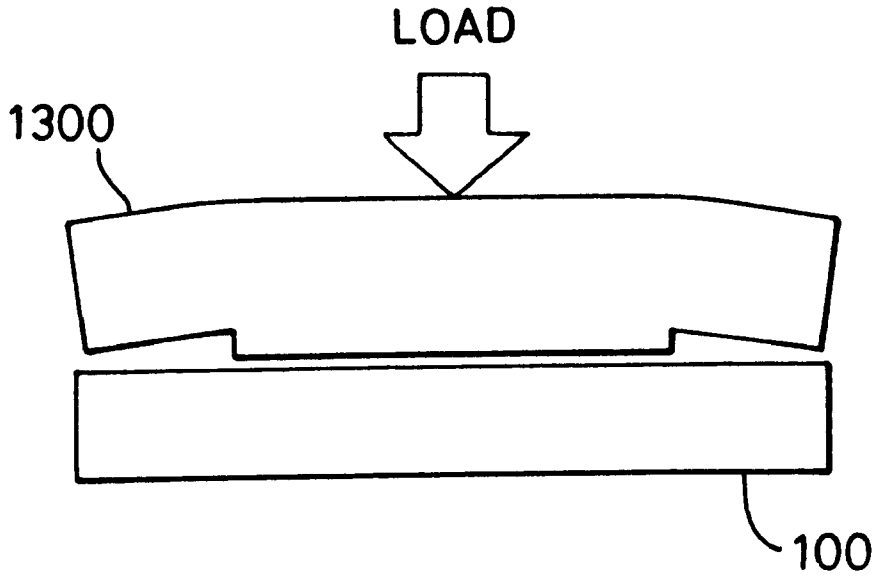
FIGS. 3A and 3B are schematic illustrations of the top plate and the heater board joined with each other.

Referring to FIG. 1, the grooves which are to form the ejection nozzles are denoted by numeral 11. The adjacent grooves 11 are separated from each other by a land portion 13 which serves as the ink channel wall. Numeral 12 denote dummy grooves which are formed in both end regions of the top plate 1300 and which do not take part in the ejection of the ink. Adjacent dummy grooves 12 are separated by land portions 14 the heights of which are smaller than the land portions which constitute the ink channel walls 13. According to this arrangement, even when the top plate 1300 has been warped such that the surface thereof having the grooves 11, 12 is convex at the central portion as illustrated in FIG. 3A, the ink channel walls 13 in the central region of the top plate 1300 can be brought into and held in contact with the heater board, under moderate pressure load applied to the top plate 1300. Consequently, each ink channel wall 13 provides a liquid-tight seal between the adjacent ink channels which constitute the ink ejecting nozzles.

The top plate 1300 having the lands of different heights can be obtained by, for example, molding a top plate blank having lands of uniform height, and then the land portions except for those providing the ink channel walls 13 are suitably ground or cut to have different heights. Alternatively, the top plate 1300 is fabricated by molding from a resin into the final configuration, by using a mold having a mold cavity defining land portions of different heights such that the land portions separating the dummy nozzles have heights smaller than those of the land portions which separate the channels or nozzles which actually perform ejection of the ink. The latter method enhances tolerance in regard to the warping of the molded top plate, thus offering a remarkable increase in the yield of the ink jet head products which employ molded top plates.

In the illustrated embodiment, an array of nozzles, each being 40 $\mu$m high, 58.5 $\mu$m wide and 400 $\mu$m long, was formed at a pitch of 70.5 $\mu$m.

The nozzle array had 64 ink ejection nozzles 11 in the central region and 18 dummy nozzles arranged at each end region of the top plate. The land portions 13 of the top plate defining 16 dummy nozzles as counted from the outermost dummy nozzle at each end region were cut to reduce their height by 10 $\mu$m, whereby a region 14 where the top plate 1300 does not contact the heater board 100 at each end of the top plate 1300. The top plate thus prepared was placed on the heater board 100 and pressed with moderate pressure load of about 1.5 kg, thus completing an ink jet head assembly. The ink jet head thus obtained was mounted on an ink jet printing apparatus embodying the present invention and was subjected to a test printing operation. High quality of print without any unevenness of thickness was confirmed.

The state of ejection of ink from the nozzles of this ink jet head was also observed. It was confirmed that each nozzle accurately ejected the ink without being affected by adjacent nozzles, i.e., without any crosstalk.

A test also was conducted by using a top plate 1300 warped such that the central crown portion is 20 μm higher than both ends of the nozzle array. The top plate 1300 was joined to the heater board 100 under moderate pressure load. In this case, as shown in FIG. 3A, close and tight contact was obtained without any substantial lifting, in the region where the ink ejection nozzles are disposed. It was also confirmed that both end regions of the top plate were kept out of contact with the heater board, thus preventing distribution of the pressure load.

Figure 3B:
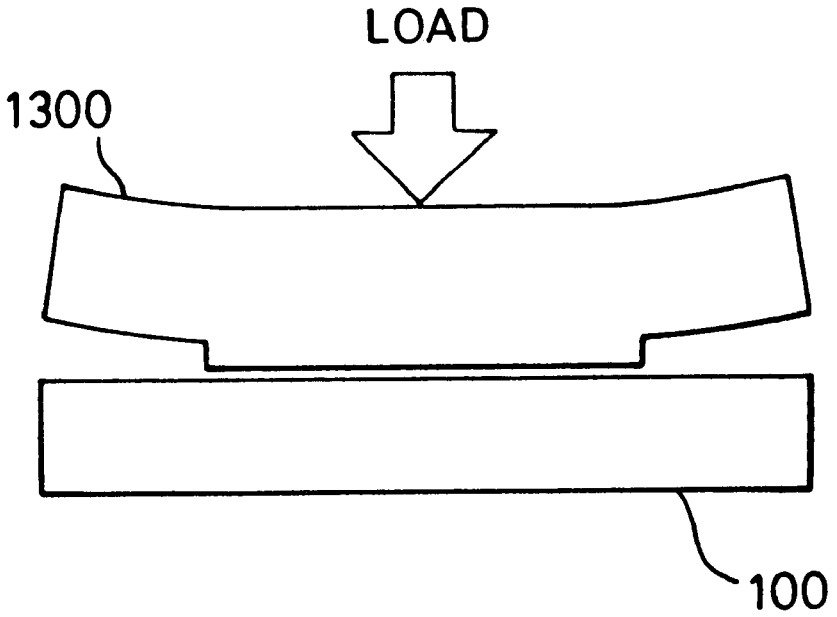

Similarly, a test was conducted by employing a top plate 1300 warped such that the central region of the plate is at a level of −20 μm with respect to both end regions of the nozzle array. The top plate 1300 was joined to the heater board 100 under moderate pressure load. In this case also, as shown in FIG. 3B, close and tight contact was obtained in the region where the ink ejection nozzles are disposed and both end regions of the top plate were kept away from the heater board.

A second embodiment will now be described. When a sealant is used to seal the ink channels and the ink chamber, the sealant tends to be spread into the ejection nozzles, particularly in the regions where the height of the land portions serving as the partition walls is small. In order to overcome this problem, the second embodiment of the present invention employs a deformable projection provided on the end of the land portions having reduced height.

Figure 4:
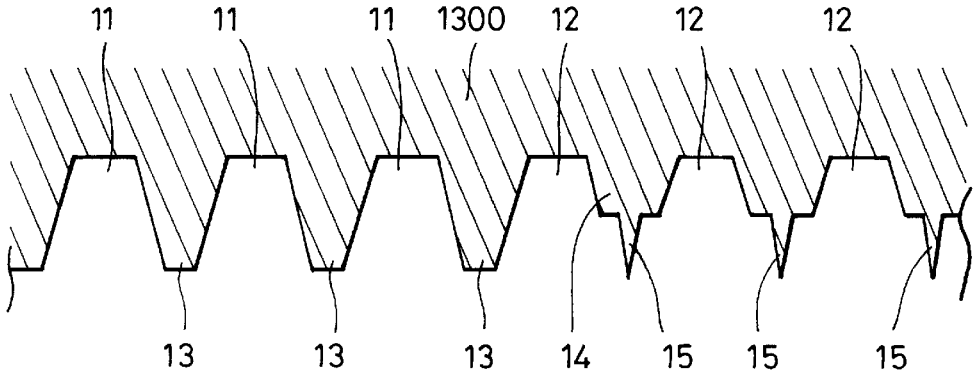
FIG. 4 is a sectional view of a nozzle forming member in accordance with a second embodiment of the present invention, showing the configuration of the joint surface at which the nozzle forming member is joined to a heater board.

FIG. 4 is a schematic sectional view of a nozzle forming member, i.e., the top plate 1300, constructed in accordance with the second embodiment of the present invention. The configuration and dimensions of the nozzles are the same as those in the first embodiment. In the second embodiment, however, the land portions defining 16 nozzles out of 18 as counted from the outermost nozzle in each end region were provided with deformable projections formed thereon so as to extend over the entire length of the land portions, i.e., 400 μm, along these land portions. The height of the deformable projections was 20 μm and the width of the same was not greater than 5 μm at the base end and not greater than 2 μm at the free end. These deformable projections were formed integrally with the top plate 1300 from a resin by molding.

The top plate 1300 was placed on the heater board and joined to the same under moderate level of pressure load, whereby an ink jet head was assembled. The ink jet head thus assembled was mounted on an ink jet printing apparatus embodying the present invention, and was subjected to test printing. Print of high quality without any unevenness of thickness could be obtained.

A similar test was conducted by changing the height of the deformable projections to 10 μm. High print quality was obtained also in this case. This advantageous effect owes to the presence of the deformable projections which provide a seal between adjacent ink nozzles so as to prevent crosstalk. The deformation of the projections takes place easily with a small force due to film-like configuration of the deformable projections, so that the pressure load is not substantially distributed but a suitable level of pressure load is applied to the central region where the ink ejection nozzles are disposed. The contact between the deformable projection and the heater board takes place at least at the region neighboring the ink ejection nozzles. Therefore, a sealant such as a silicone adhesive, which is used for the purpose of sealing the nozzles and ink chamber (not shown) formed by the top plate 1300 and the heater board 100 is prevented from coming into the nozzles even when the viscosity of the adhesive is very low.

Figure 5:
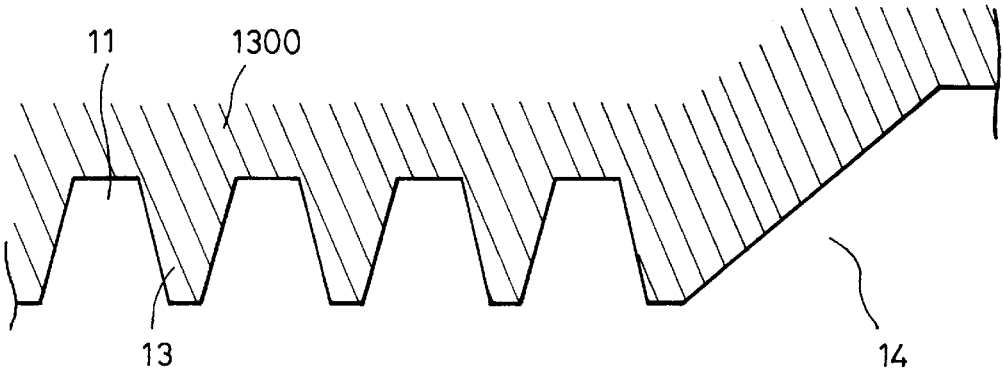
FIG. 5 is a sectional view of a nozzle forming member in accordance with a third embodiment of the present invention, showing the configuration of the joint surface at which the nozzle forming member is joined to a heater board.
Figure 6:
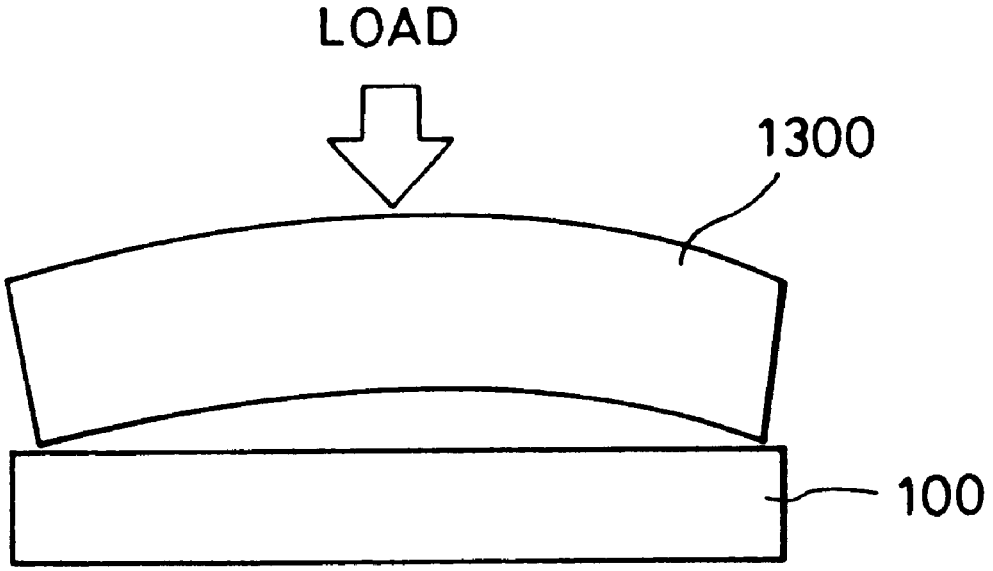
FIG. 6 PRIOR ART
FIG. 6 is a schematic illustration of the state of jointing between a nozzle forming member and a heater board in a known ink jet head.

A third embodiment of the present invention will now be described. FIG. 5 is an illustration of the joining surface of a nozzle forming member, i.e., the top plate 1300, used in the third embodiment of the present invention. Shapes and dimensions of the nozzles formed by this nozzle forming member are the same as those of the first embodiment. In this embodiment, two dummy nozzles are formed at each side of the ejection nozzle region and each end portion of the top plate 1300 outside these dummy nozzles is shaped such that the end extremity of the top plate is 80 μm apart from the joining surface of the heater board, thus providing a non-contact region where the top plate 1300 does not contact with the heater board 100, at each end of the top plate 1300.

The top plate 1300 was placed on the heater board and joined to the same under moderate level of pressure load, whereby an ink jet head was assembled. The ink jet head thus assembled was mounted on an ink jet printing apparatus embodying the present invention, and was subjected to test printing. Print of high quality without any unevenness of thickness could be obtained.

What is claimed is:

1. An ink jet head comprising:

a first member having a plurality of energy generating elements for generating energy to eject an ink;

a second member having a plurality of grooves separated from one another by land portions, said grooves defining an array of ink channels leading to an array of ink ejecting openings, said array of ink channels having two end portions and a central portion, and said land portions defining a plurality of ink channel walls, each said ink channel wall having a height, separating the ink channels, and the heights of said ink channel walls are smaller at both said end portions of said array of ink channels than at the central portion of said array of ink channels, wherein at least some of those of said ink channel walls having smaller heights are provided with a deformable projection formed thereon so as to be contactable with said first member; and a pressing member for pressing said first member and said second member against one another thereby joining said first and said second members so that said ink channels are formed by cooperation between said first member and said grooves in said second member.

2. An ink jet head according to claim 1, wherein those of the ink channel walls having smaller heights are provided in regions where ejection of ink is not performed.

3. An ink jet head according to claim 2, wherein said second member is formed from a resin.

4. A method of producing an ink jet head, comprising the steps of:

preparing a first member having a plurality of energy generating elements for generating energy to eject an ink;

preparing a second member having a plurality of grooves separated by land portions, said grooves defining an array of ink channels leading to an array of ink ejecting openings, said array of ink channels having two end portions and a central portion, and said land portions defining a plurality of ink channel walls, each said ink channel wall having a height, separating said ink channels, and the heights of the ink channel walls are smaller at both the end portions of the array of ink channels than at the central portion of the array of ink channels, wherein at least some of those of said ink channel walls having smaller heights are each provided with a deformable projection formed thereon so as to be contactable with said first member; and preparing a pressing member for pressing said first member and said second member against one another;

bringing said first member and said second member into contact with each other such that said energy generating elements are aligned with said grooves;

pressing said first member and said second member against one another by said pressing member thereby joining said first and said second members so that said ink channels are formed by cooperation between said first member and said grooves in said second member.

5. A method of producing an ink jet head according to claim 4, wherein the ink channel walls having smaller heights are provided in regions where ejection of ink is not performed.

6. A method of producing an ink jet head according to claim 4, wherein said second member is formed integrally by molding from a resin.

* * * * *

UNITED STATES PATENT AND TRADEMARK OFFICE

CERTIFICATE OF CORRECTION

PATENT NO. : 6,133,926
DATED : October 17, 2000
INVENTOR(S) : Jun Kawai et al.

It is certified that error appears in the above-identified patent and that said Letters Patent is hereby corrected as shown below:

Title page,

Insert: -- (*) Notice: This patent issued on a continued pro-ecution application filed under 37 CFR 1.53(d), and is subject to the twenty year patent term provisions of 35 U.S.C. 154(a)(2). --; and Item [57] ABSTRACT,

Line 41, "grooves in said" should read -- the grooves in the --; and "of ink" should read -- of the ink --.

Column 2,

Line 16, "of the" should read -- of --.

Column 3,

Line 15, "pressing" should read -- and pressing --.

Column 4,

Line 49, "which to" should read -- which --; and
Line 57, "receive s" should read -- receives --.

Column 7,

Line 25, "gularly" should read -- gular --; and "rectangular" should read -- rectangularly --;
Line 27, "equals to the" should read -- equals the --; and
Line 39, "to reduction" should read -- to a reduction --.

Column 8,

Line 7, "surfaces" should read -- surface --; and
Line 51, "carriage," should read -- carriage HC, --.

Column 9,

Line 53, "serves" should read -- serve --.

Column 10,

Line 2, "is" should be deleted; and
Line 5, "20" should be deleted.

UNITED STATES PATENT AND TRADEMARK OFFICE

CERTIFICATE OF CORRECTION

PATENT NO. : 6,133,926
DATED : October 17, 2000
INVENTOR(S) : Jun Kawai et al.

It is certified that error appears in the above-identified patent and that said Letters Patent is hereby corrected as shown below:

Column 12,
Line 25, "denote" should read -- denotes --.

Signed and Sealed this

Eighteenth Day of December, 2001

*Attest:*

*Attesting Officer*

JAMES E. ROGAN
*Director of the United States Patent and Trademark Office*